US007697711B2

(12) United States Patent
Whitehouse et al.

(10) Patent No.: US 7,697,711 B2
(45) Date of Patent: Apr. 13, 2010

(54) PERFORATED PLATE INCLUDING EMBEDDED GRAPHICS

(75) Inventors: Ryan P. Whitehouse, Eagan, MN (US); Daniel Koren, Burnsville, MN (US)

(73) Assignee: Bosch Security Systems, Inc., Fairport, NY (US)

( * ) Notice: Subject to any disclaimer, the term of this patent is extended or adjusted under 35 U.S.C. 154(b) by 1125 days.

(21) Appl. No.: 11/332,694

(22) Filed: Jan. 13, 2006

(65) Prior Publication Data

US 2006/0182299 A1 Aug. 17, 2006

Related U.S. Application Data

(60) Provisional application No. 60/644,096, filed on Jan. 13, 2005.

(51) Int. Cl.
*H04R 1/02* (2006.01)
*H04R 25/00* (2006.01)

(52) U.S. Cl. ..... 381/391; 381/189

(58) Field of Classification Search ..... 381/391
See application file for complete search history.

(56) References Cited

U.S. PATENT DOCUMENTS

| | | | | |
|---|---|---|---|---|
| 798,759 | A | 9/1905 | Bacon | |
| 1,538,236 | A | 5/1925 | Brandt | |
| 1,610,447 | A | 12/1926 | Humphrey | |
| 1,723,952 | A | 8/1929 | Roth | |
| 1,773,622 | A | 8/1930 | Jackson | |
| 1,876,405 | A | 9/1932 | Enscott | |
| 1,879,057 | A | 9/1932 | Bray | |
| 1,884,724 | A | 10/1932 | Keller | |
| 1,894,857 | A | 1/1933 | Dwyer et al. | |
| 2,891,338 | A | 6/1959 | Palamara | |
| 3,530,615 | A | 9/1970 | Meyer | |
| 3,961,434 | A | 6/1976 | Sampson | |
| 3,987,558 | A | 10/1976 | Tsukamoto | |
| 4,208,811 | A | 6/1980 | Junowicz | |
| 4,520,053 | A | 5/1985 | Marentic | |
| 4,817,163 | A | 3/1989 | Stastny | |
| 4,860,476 | A | 8/1989 | Hall | |
| 5,239,800 | A * | 8/1993 | Edwards et al. | 52/455 |
| 5,644,860 | A | 7/1997 | Piper et al. | |
| 6,271,814 | B1 | 8/2001 | Kaoh | |
| D474,242 | S | 5/2003 | Barnes | |
| 6,667,576 | B1 | 12/2003 | Westhoff | |
| 2002/0137473 | A1 * | 9/2002 | Jenkins | 455/90 |
| 2005/0050615 | A1 * | 3/2005 | Stickney | 2/311 |

FOREIGN PATENT DOCUMENTS

| | | |
|---|---|---|
| DE | 2612941 | 9/1977 |
| DE | 2855534 | 11/1979 |
| GB | 1431181 | 4/1976 |
| JP | 01151899 | 6/1989 |
| JP | 2005 210661 A | 8/2005 |

* cited by examiner

*Primary Examiner*—Brian Ensey
*Assistant Examiner*—Matthew Eason
(74) *Attorney, Agent, or Firm*—Fredrikson & Byron, P.A.

(57) ABSTRACT

A perforated plate includes a plurality of holes divided into a first set of holes and a second set of holes. Each hole in the second set of holes has an area smaller than that of each hole in the first set; and the holes of the first and second sets are arranged with respect to one another to form a graphic pattern.

20 Claims, 3 Drawing Sheets

PERFORATED PLATE INCLUDING EMBEDDED GRAPHICS

RELATED APPLICATION

The present application claims priority to provisional application Ser. No. U.S. 60/644,096, and hereby incorporates said application, in its entirety, herein.

TECHNICAL FIELD

The present invention pertains to perforated plates and more particularly to perforated plates including embedded graphics.

BACKGROUND

Perforated plates are often used as protective grilles, for example on automobiles or loudspeakers, or as added architectural detail. In example, loudspeaker transducers are typically contained in housings having open fronts for sound transmission. To protect the transducers, perforated plates or grilles typically cover the open fronts of loudspeaker housings. These grilles include an array of holes, the size and density of which are sufficient to pass sound emanating from the transducers, which are disposed behind the grilles within the housing. Because loudspeakers are positioned to project the sound of a performing individual or group, either live or recorded, toward an audience, the grilles of loudspeakers often face the audience. It would be desirable for these loudspeakers to also provide a visual logo or other type of graphic information, for example, associated with either the performer(s) or the loudspeaker manufacturer or both. Likewise, it is desirable that perforated plates used in other applications include embedded graphics to convey information.

BRIEF SUMMARY

According to embodiments of the present invention a plate or grille includes a plurality of holes divided into a first set and a second set. Each hole in the second set of holes has an area smaller than that of each hole in the first set; and the first and second sets are arranged with respect to one another to form a graphic pattern. A ratio of first set to second set holes sizes, in terms of area, may be between approximately 1.8 and approximately 10. A backing layer may be disposed behind the grille to provide a visual contrast with the grille.

Although embodiments of the present invention are described in the context of loudspeakers the invention is not so limited and can be applied in other contexts, for example, architectural and automotive.

BRIEF DESCRIPTION OF THE DRAWINGS

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides practical illustrations for implementing exemplary embodiments of the present invention.

Figure 1:
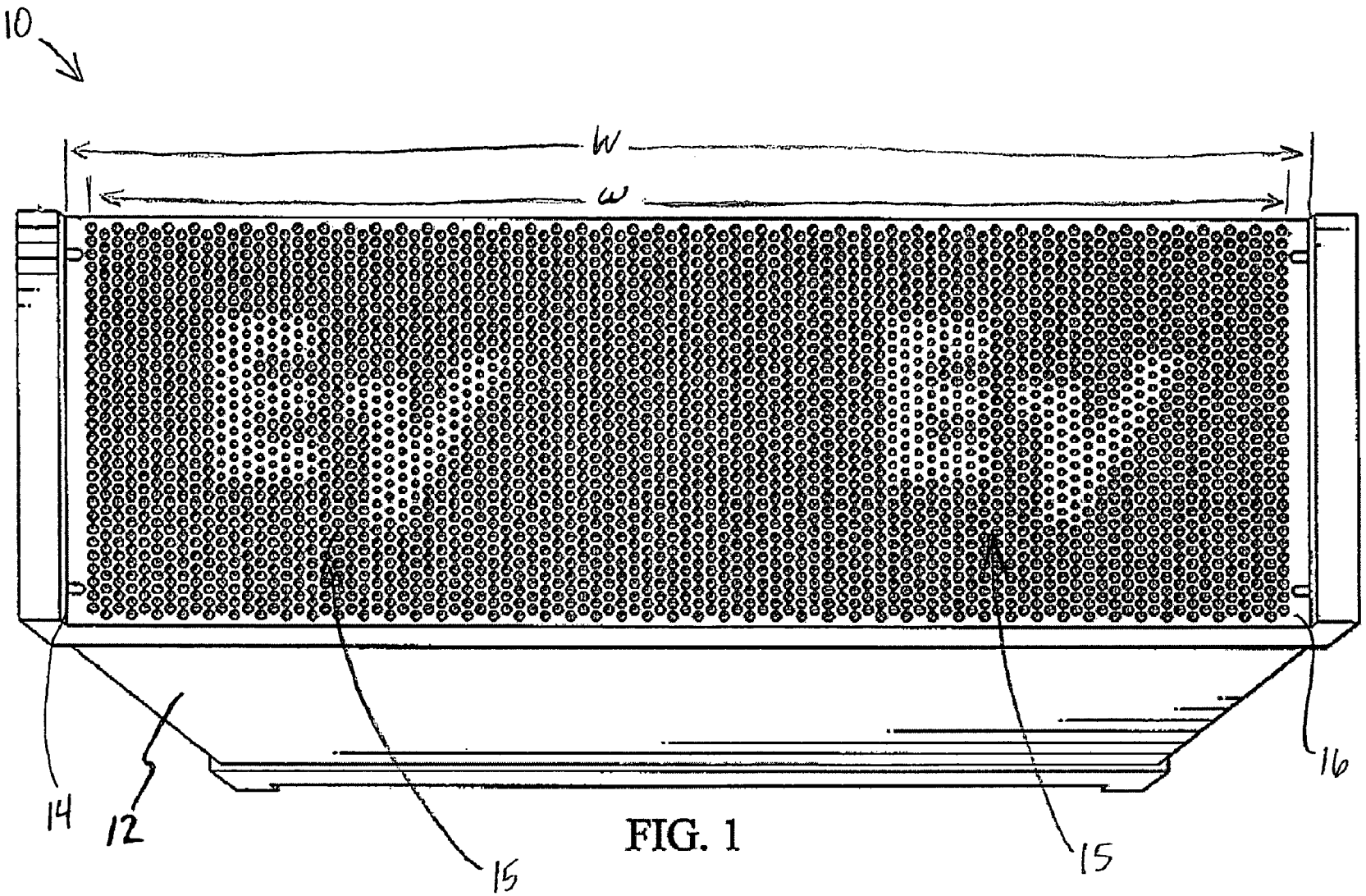
FIG. 1 is a perspective view of a loudspeaker according to one embodiment of the present invention.
Figure 2B:
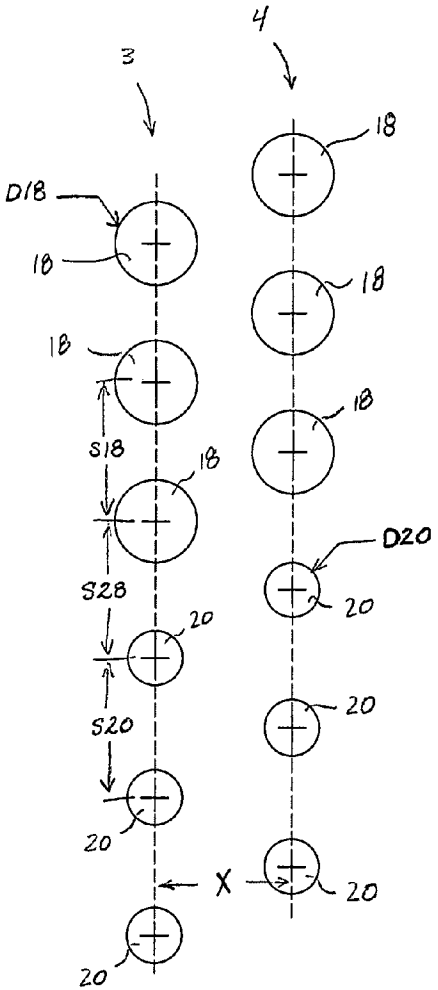
FIG. 2B is an enlarged detail of the grille shown in FIG. 2A.
Figure 2A:
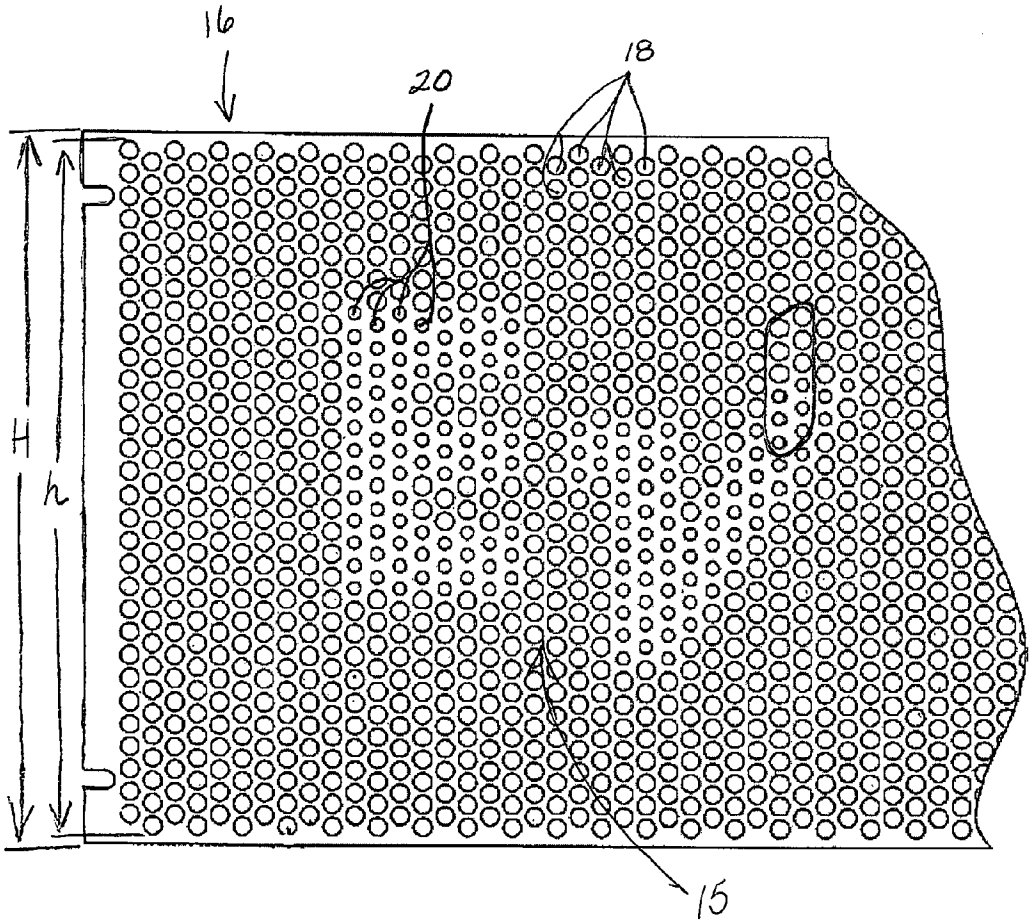
FIG. 2A is a plan view of a portion of a grille from the loudspeaker shown in FIG. 1.

FIG. 1 is a perspective view of a loudspeaker 10 according to one embodiment of the present invention. FIG. 1 illustrates loudspeaker 10 including a housing 12 that contains one or more transducers (not shown) and having an open front side 14 covered by a perforated plate or grille 16; one or more speaker connections (not shown) extend from a rear side of housing. The transducer(s), having been installed through front side 14, are enclosed within housing 12 by attaching grille 16 over front side 14 of housing 12; the transducers face toward grille 16 to project sound out of housing 12 through grille 16; holes or perforations of grille 16 are large enough and numerous enough to allow sufficient passage of sound out from housing 12. Grille 16, according to one example, is stamped out of sheet metal, however grille 16 may formed with the holes and may be constructed from any or a combination of metal, polymer and ceramic, for example. According to the illustrated embodiment one or more graphic patterns 15, in a shape of letters "E" and "V", are formed by an arrangement of some of the holes. The arrangement of the holes or perforations may be better understood with reference to FIGS. 2A-B FIG. 2A is a plan view of a portion of grille 16. FIG. 2A illustrates grille 16 including a first set of holes, for example including holes 18, and a second set of holes, for example including holes 20; according to embodiments of the present invention, each hole of the first set has an area larger than that of each hole of the second set, and the first and second sets of holes are arranged with respect to one another so as to form a graphic pattern, for example pattern 15. Referring back to FIG. 1, it may be appreciated that pattern 15 is more discernable from a distance away from speaker 10. A ratio of hole sizes in the first set to hole sizes in the second set, according to embodiments of the present invention, range between approximately 1.8:1 and 10:1, when size is measured as area in square units. Resolution of an embedded pattern, for example pattern 15, may be reduced or increased by varying a ratio between hole sizes of the first and second sets, and/or by dividing all the holes up into a greater number of sets having different holes sizes. Although the holes, i.e. holes 20, of the second set are shown being surrounded by the larger holes, i.e. holes 18, of the first set to form graphic pattern 15, alternate embodiments of the present invention include larger holes being surrounded by smaller holes to form an embedded graphic pattern.

FIG. 2A further illustrates all of the holes arranged in a plurality of columns, each of which extend to approximately a height h, which is less than a height H of plate 16; although height h in FIG. 2A looks to be very close to height H, the scope of the present invention is not so limited. With reference to FIG. 1, the columns of holes are shown extending, side-by-side, across a width w which is less than a width W of plate 16; width w may be very close to width W of plate 16 or substantially less than width W. Further detail with respect to the arrangement of the holes, according to the illustrated embodiment, may be appreciated with reference to FIG. 2B, which shows a portion of two columns 3, 4.

FIG. 2B is an enlarged portion of grille 16 that is circled in FIG. 2A. FIG. 2B illustrates columns 3 and 4 defined by vertical dashed lines, and a center point of each hole, indicated with "+", aligned along the columns, but staggered across the columns; columns 3 and 4 are shown spaced apart by a distance x, which may be generally uniform across width w, as illustrated in FIG. 1, or variable from one pair of columns to the next. FIG. 2B further illustrates holes 18, included in the first set of holes, having a diameter D18, and holes 20, included in the second set of holes, having a diameter D20, which is less than diameter D18. According to preferred embodiment D18 is approximately ¼ of an inch and D20 is approximately 3/16 of an inch, so that a ratio of D18 to D20 is approximately 1.3:1 and a size ratio, according to area, is approximately 1.8:1. Although the holes, according to the illustrated embodiment, are round, the scope of the present invention is not limited to this hole shape.

Distances between center points of holes, within each column, are shown in column 3 as: S18 for a distance between center points of adjacent holes 18 of the first set; S20 for a distance between center points of adjacent holes 20 of the second set; and S28 for a distance between a center point of adjacent holes 18 and 20 at a boundary between the first and second sets. According to the illustrated embodiment, distances S18, S20 and S28 are generally uniform within each column and from column to column, and are approximately equivalent to one another; however the scope of the present invention is not so limited.

Figure 3:
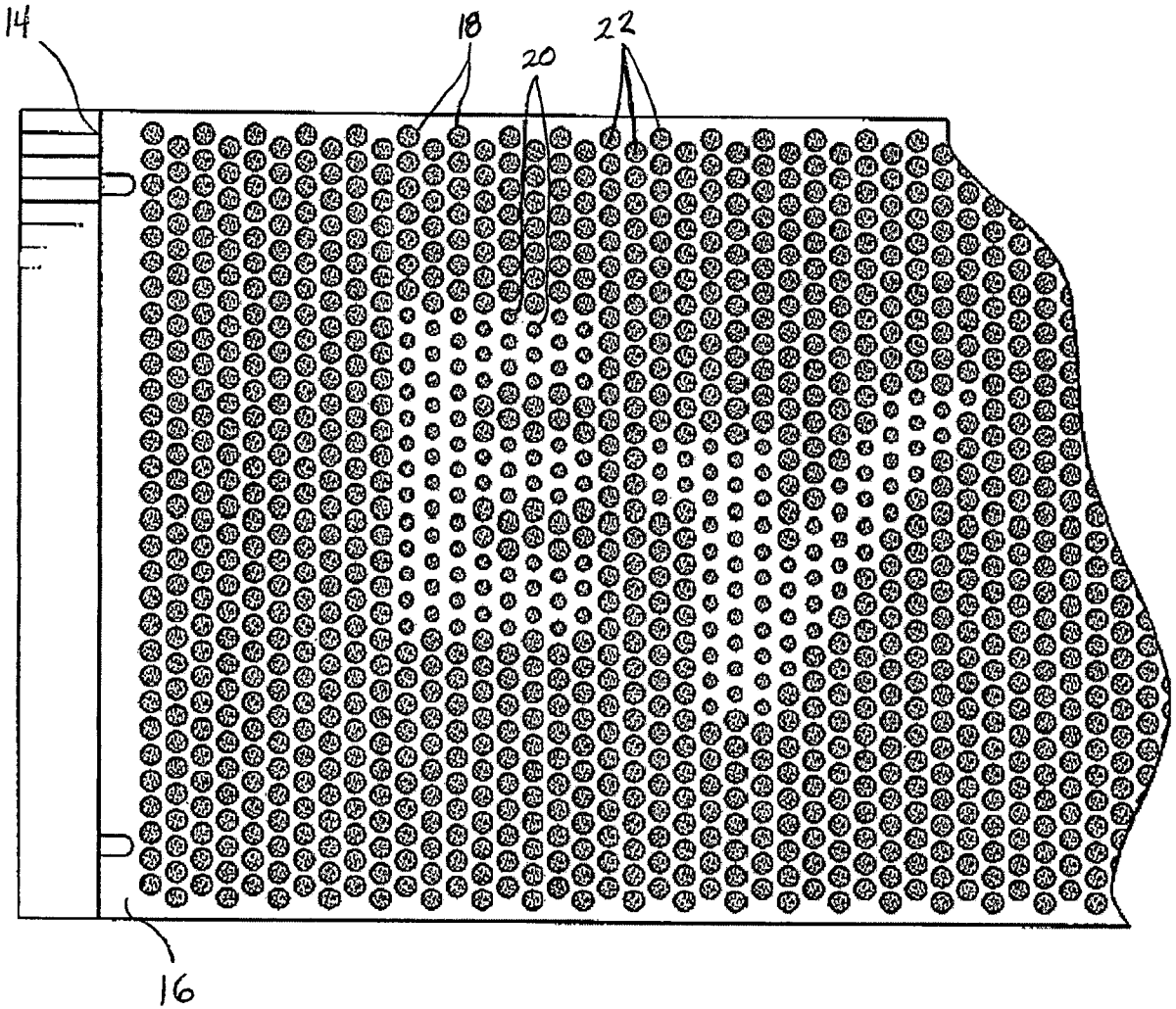
FIG. 3 is a plan view of a portion of the loudspeaker shown in FIG. 1.

FIG. 3 is a plan view of a portion of loudspeaker 10 shown in FIG. 1. FIG. 3 illustrates loudspeaker 10 including a backing layer 22 disposed adjacent an inner surface of the plate, either being secured within housing 12, or covering open front 14 of housing, along with grille 16, being secured just behind grille 16; according to some embodiments, backing layer extends into the holes of grille 16. Backing layer 22 may enhance the resolution of embedded graphics, for example graphic pattern 15, but is not a necessary element for all embodiments of the invention; a natural background provided, for example, by inside of speaker housing 12, may serve to enhance the resolution. According to those embodiments of the present invention that include backing layer 22 for enhanced resolution, backing layer 22 allows acoustic transmission therethrough while providing a visual contrast with grille 16, as seen through the holes of grille; the contrast may be one of color, luster, texture, or a combination of any of these. Suitable materials from which backing layer may be formed include, but are not limited to fabric, foam, or another perforated plate, plastic or metal.

In the foregoing detailed description, the invention has been described with reference to specific embodiments. However, it may be appreciated that various modifications and changes can be made without departing from the scope of the invention as set forth in the appended claims. For example, although grille 16 of the illustrated embodiment is shown to be relatively flat and having linear edges, the scope of the present invention includes perforated plates having curved surfaces and/or edges. Furthermore, perforated plates of the present invention may be used for applications other than loudspeaker grilles.

The invention claimed is:

1. A loudspeaker, comprising:

a housing including an open front side; and a plate covering the front side of the housing and including a plurality of holes arranged in a plurality of columns, each hole extending through a thickness of the plate and including a center point;

the center points of the plurality of holes being generally aligned along each column of the plurality of columns and staggered across the plurality columns;

the plurality of holes including a first set of holes and a second set of holes, each hole of the first set having an area greater than an area of each hole of the second set; and the second set of holes disposed within the plurality of columns with respect to the first set of holes to form a discernable graphic pattern.

2. The loudspeaker of claim 1, wherein the plate further includes an inner surface facing the housing; and, further comprising a backing layer disposed adjacent the inner surface of the plate.

3. The loudspeaker of claim 2, wherein portions of the backing layer extend into at least a portion of the plurality of holes.

4. The loudspeaker of claim 2, wherein the plate further includes an outer surface facing away from the housing and the backing layer includes an outer surface facing the plurality of holes; the backing layer contrasting with the outer surface of the plate and the contrast being at least one of color, luster and texture.

5. The loudspeaker of claim 1, wherein in the center points of the plurality of holes are equally spaced apart along each column of the plurality of columns.

6. The loudspeaker of claim 1, wherein the plurality of columns are equally spaced apart.

7. The loudspeaker of claim 1, wherein a height of each of the plurality of columns extends substantially over a height of the plate.

8. The loudspeaker of claim 1, wherein the plurality of columns, side-by-side, extend substantially across a width of the plate.

9. The loudspeaker of claim 1, wherein the area of each hole of the first set is between approximately 1.8 times and approximately 10 times greater than the area of each hole of the second set.

10. The loudspeaker of claim 1, wherein each of the plurality of holes are round and the diameter of each hole of the first set is approximately 0.25 inch and the diameter of each hole of the second set is approximately 0.188 inch.

11. The loudspeaker of claim 1, wherein the first set of holes surrounds the second set of holes.

12. A perforated plate, comprising a plurality of holes arranged in a plurality of columns, each hole extending through a thickness of the plate and including a center point; the center points of the plurality of holes being generally aligned along each column of the plurality of columns and staggered across the plurality columns; the plurality of holes including a first set of holes and a second set of holes, each hole of the first set having an area greater than an area of each hole of the second set; and the second set of holes disposed within the plurality of columns with respect to the first set of holes to form a discernable graphic pattern.

13. The perforated plate of claim 12, wherein in the center points of the plurality of holes are equally spaced apart along each column of the plurality of columns.

14. The perforated plate of claim 12, wherein the plurality of columns are equally spaced apart.

15. The perforated plate of claim 12, wherein a height of each of the plurality of columns extends substantially over a height of the plate.

16. The perforated plate of claim 12, wherein the plurality of columns, side-by-side, extend substantially across a width of the plate.

17. The perforated plate of claim 12, wherein the area of each hole of the first set is between approximately 1.8 times and approximately 10 times greater than the area of each hole of the second set.

18. The perforated plate of claim 12, wherein each of the plurality of holes is round and the diameter of each hole of the first set is approximately 0.25 inch and the diameter of each hole of the second set is approximately 0.188 inch.

19. The perforated plate of claim 12, wherein the first set of holes surrounds the second set of holes.

20. A method of embedding a graphic pattern on an outer surface of a loudspeaker, the method comprising attaching a plate to a housing of the loudspeaker to form the outer surface of the loudspeaker; the plate including a plurality of holes extending through a thickness of the plate; the plurality of holes arranged in a plurality of columns such that center points of the plurality of holes are generally aligned along each column of the plurality of columns and staggered across the plurality of columns; the plurality of holes including a first set of holes and a second set of holes, each hole of the first set having an area greater than an area of each hole of the second set; and the second set of holes disposed within the plurality of columns with respect to the first set of holes to form the graphic pattern, the graphic pattern being discernable on the plate.

* * * * *